US008006423B1

(12) United States Patent
Alzamora et al.

(10) Patent No.: US 8,006,423 B1
(45) Date of Patent: Aug. 30, 2011

(54) MAGAZINE FOLLOWER FOR A MAGAZINE USED BY A FIREARM

(75) Inventors: Ronny Alzamora, Belleville, NJ (US); John Heinsohn, Budd Lake, NJ (US); Adam Foltz, Budd Lake, NJ (US)

(73) Assignee: The Unites States of America as represented by the Secretary of the Army, Washington, DC (US)

( * ) Notice: Subject to any disclaimer, the term of this patent is extended or adjusted under 35 U.S.C. 154(b) by 1414 days.

(21) Appl. No.: 10/711,630

(22) Filed: Sep. 29, 2004

(51) Int. Cl.
*F41A 9/61* (2006.01)

(52) U.S. Cl. ..... 42/49.01; 42/50; 42/7

(58) Field of Classification Search ..... 42/49.01, 42/50, 7

See application file for complete search history.

(56) References Cited

U.S. PATENT DOCUMENTS 1,323,063 A * 11/1919 Johnson et al. ..... 42/50
3,465,463 A * 9/1969 Batezell et al. ..... 42/50
D244,285 S * 5/1977 Sofinowski ..... D22/108
4,109,401 A * 8/1978 Musgrave ..... 42/50
4,495,720 A * 1/1985 Bross ..... 42/7
4,502,237 A * 3/1985 Krogh ..... 42/50
5,113,605 A * 5/1992 Kim ..... 42/50
5,263,273 A * 11/1993 Lishness ..... 42/50
5,329,718 A * 7/1994 Howard ..... 42/50
5,357,703 A * 10/1994 Chesnut et al. ..... 42/50
5,638,626 A * 6/1997 Westrom ..... 42/50
5,956,878 A * 9/1999 Yang ..... 42/50

* cited by examiner

*Primary Examiner* — Michelle Clement
(74) *Attorney, Agent, or Firm* — Michael C Sachs

(57) ABSTRACT

An improved magazine follower for use in existing magazines such as a 30 round magazine comprises a follower plate, a base plate, and a spring. The follower plate comprises a top plate, a convex follower leg, and a concave follower leg. The external shapes of the top plate, the convex follower leg, and the concave follower leg mirror the interior profile of the magazine, constraining the motion of the follower plate to a well-defined path within the magazine. The method of attaching the spring to the follower plate and the base plate in addition to the shape of the spring keeps the spring from "wobbling" or moving off a vertical axis of the spring as rounds of ammunition are loaded or dispensed. Consequently, the present system reduces binding or jams within the magazine, improving performance and life of the magazine follower.

15 Claims, 7 Drawing Sheets

MAGAZINE FOLLOWER FOR A MAGAZINE USED BY A FIREARM

U.S. GOVERNMENTAL INTEREST

The inventions described herein may be manufactured, used and licensed by or for the U.S. Government for U.S. Government purposes.

FIELD OF THE INVENTION

The present invention generally relates to a firearm. More specifically, the present invention relates to a magazine for chambering ammunition in the firearm. In particular, the present invention pertains to a magazine follower in the magazine that provides a force on the ammunition within the magazine to chamber the ammunition without jamming.

BACKGROUND OF THE INVENTION

Automatic and semi-automatic firearms typically comprise a magazine in which one or more rounds of ammunition are placed. The magazine comprises a magazine follower that pushes the topmost round into position for chambering in the automatic or semi-automatic firearm. For example, a M16 Rifle or M4 Carbine comprises a 30 round magazine. The first round placed in the magazine presses against the magazine follower. Additional rounds placed in the magazine compress the magazine follower toward the bottom of the magazine. The magazine follower comprises, for example, a spring that applies force to the rounds in the magazine, pushing the rounds up toward the chamber of the automatic or semi-automatic firearm.

Although conventional magazine technology has proven to be useful, it would be desirable to present additional improvements. A conventional 30 round magazine comprises a magazine follower that has a tendency to jam and not properly feed the round into the automatic or semi-automatic firearm. As rounds are loaded into the magazine, an off-center pressure on the magazine follower can cause the magazine follower to bind, interrupting and slowing the process of loading rounds in the magazine. Thus, there is need for an improved magazine follower that does not jam or bind during loading of the magazine or firing of the automatic or semi-automatic firearm. The need for such a system has heretofore remained unsatisfied.

SUMMARY OF THE INVENTION

The present invention satisfies this need, and presents a system and an associated method (collectively referred to herein as "the system" or "the present system") for an improved magazine follower for use in existing magazines such as a 30 round magazine. While described in relation to a 30 round magazine, the present system can be used in any magazine.

The present system comprises a follower plate, a base plate, and a spring. The present system is a replacement for a conventional magazine follower in a magazine. The present system is placed in the magazine with the base plate inserted first and fitted snugly against the bottom of the magazine. One or more rounds of ammunition are placed in the magazine against the follower plate. The spring pushes against the follower plate and the rounds of ammunition, presenting the top-most round of ammunition for loading into the firearm. In loading and dispensing rounds of ammunition in the magazine, the follower plate slides up and down inside the magazine. Pushing downward (with respect to the bottom of the magazine) on the follower plate causes the follower plate to slide down. The force of the spring on the follower plate causes the follower plate to slide up.

The follower plate comprises a convex follower leg and a concave follower leg. The external shape of the convex follower leg and the concave follower leg mirrors the interior profile of the magazine, tracking the interior of the magazine as the follower plate is pushed upward by the spring. By mirroring the interior profile of the magazine, the present system constrains the motion of the follower plate to a well-defined path within the magazine. The present system reduces jamming and high friction points throughout a cycle of loading and dispensing rounds of ammunition. In conventional magazine followers, high friction points cause stress or wear on the magazine follower, further causing the magazine follower to jam or otherwise malfunction.

In one embodiment, the follower plate comprises two convex follower legs. In another embodiment, the follower plate comprises or two concave follower legs. For proper function of the magazine follower, a requirement for the shape of the follower legs is that the follower legs mirror the interior profile of the magazine, whether convex, concave, or flat.

The follower plate comprises a perimeter profile that mirrors the interior profile of the magazine. As before, by mirroring the interior profile of the magazine, the present system constrains the motion of the follower plate to a well-defined path within the magazine. Consequently, the present system reduces jamming and high friction points throughout a cycle of loading and dispensing rounds of ammunition.

The spring is attached to the follower plate by inserting a follower end of the spring into a follower opening in a central stud on the bottom of the follower plate. The spring is designed such that at least one turn of the spring presses against the bottom of the follower plate to provide an evenly distributed force to the follower plate. The spring is attached to the base plate by inserting a base end of the spring into a base opening in a base stud on the top of the base plate. The spring is designed such that at least a portion of a turn of the spring presses against the top of the base plate to provide and evenly distributed force to the follower plate.

The circumferential shape of the spring is elongated such that the spring generally mirrors the profile of the magazine. The method of attaching the spring to the follower plate and the base plate in addition to the shape of the spring keeps the spring from "wobbling" or moving off a vertical axis of the spring as rounds of ammunition are loaded or dispensed. Consequently, movement of the spring is constrained to compression and expansion, further preventing binding or jams within the magazine and improving life of the magazine follower.

The follower plate comprises a composite material that is inexpensive and cost-effective to manufacture. Furthermore, the composite material exhibits high performance characteristics such as, for example, chemical resistance, heat deflection, tensile strength, stiffness, and low temperature impact strength.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

Figure 1A:
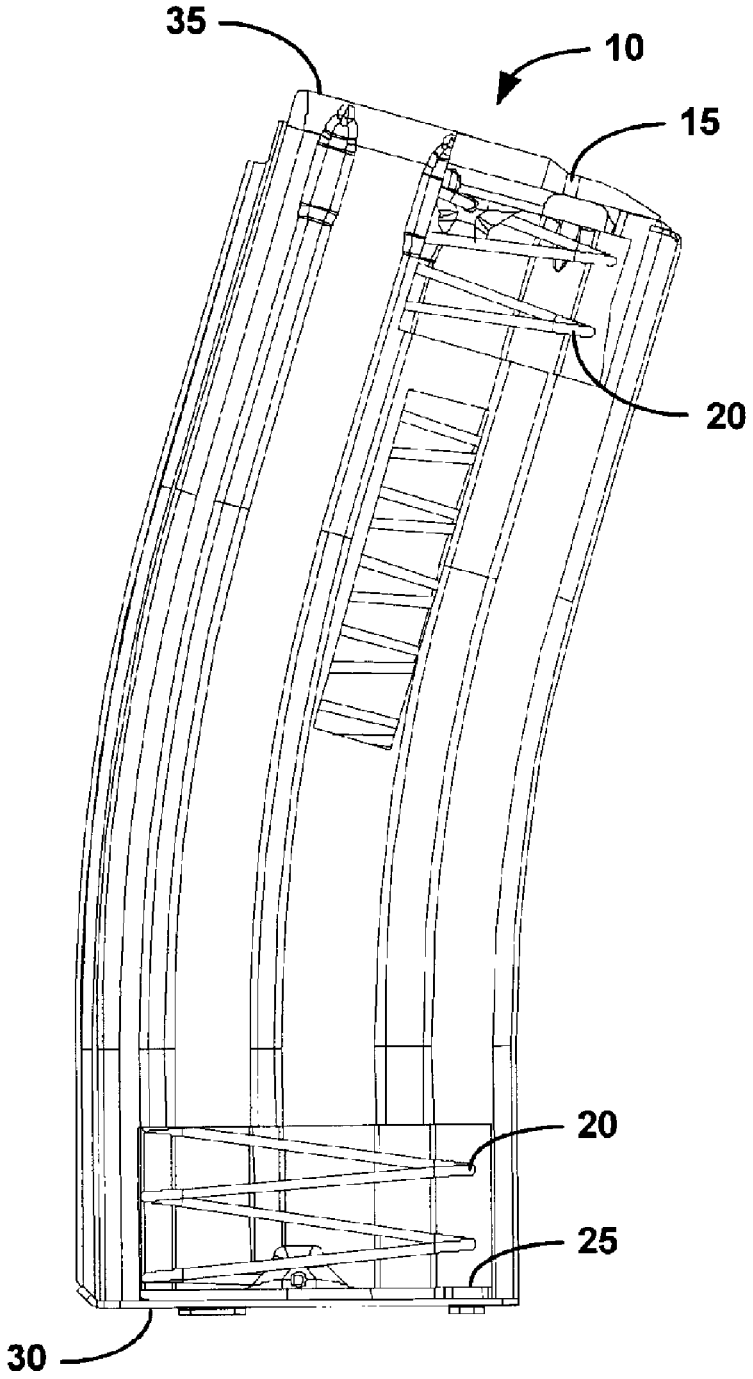
FIG. 1 is comprised of FIGS. 1A, 1B, 1C, 1D, 1E, and 1F and represents diagrams illustrating an exemplary magazine in which an improved magazine follower of the present invention can be used.
Figure 1B:
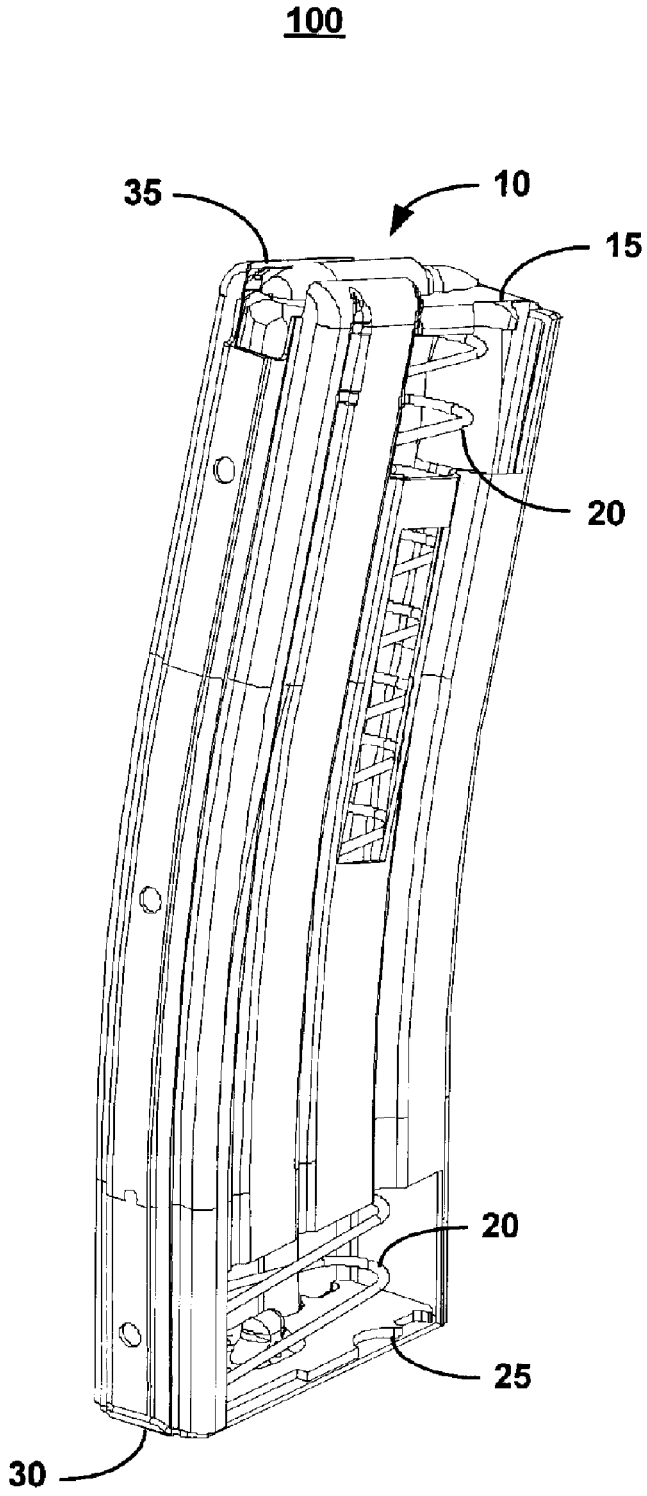
Figure 1C:
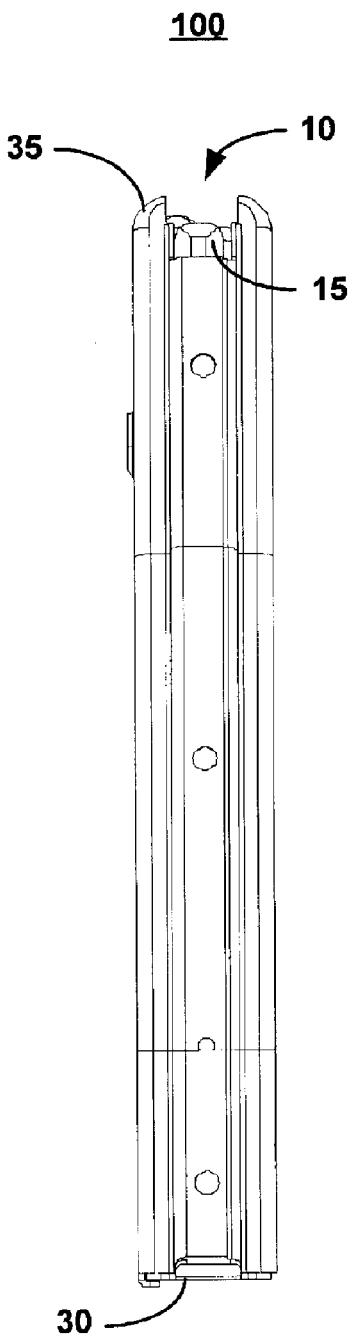
Figure 1D:
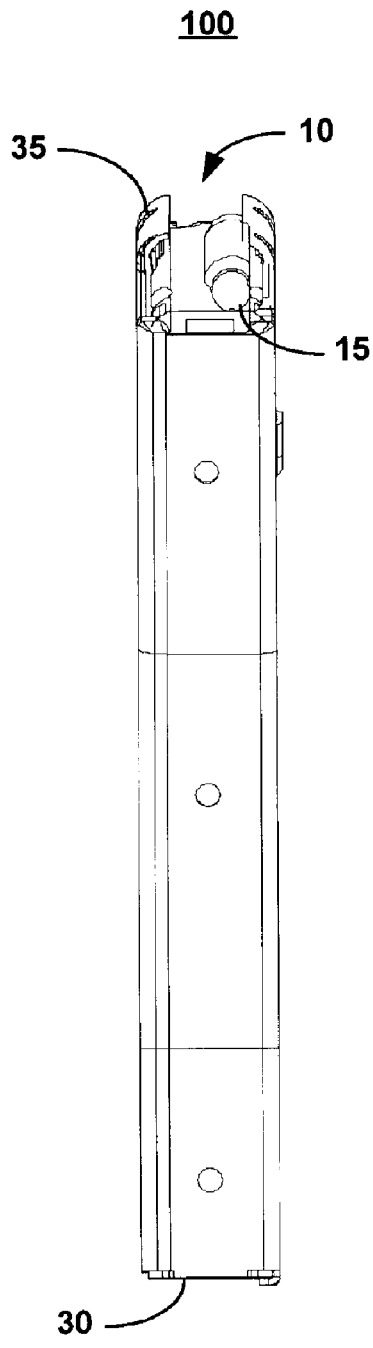
Figure 1E:
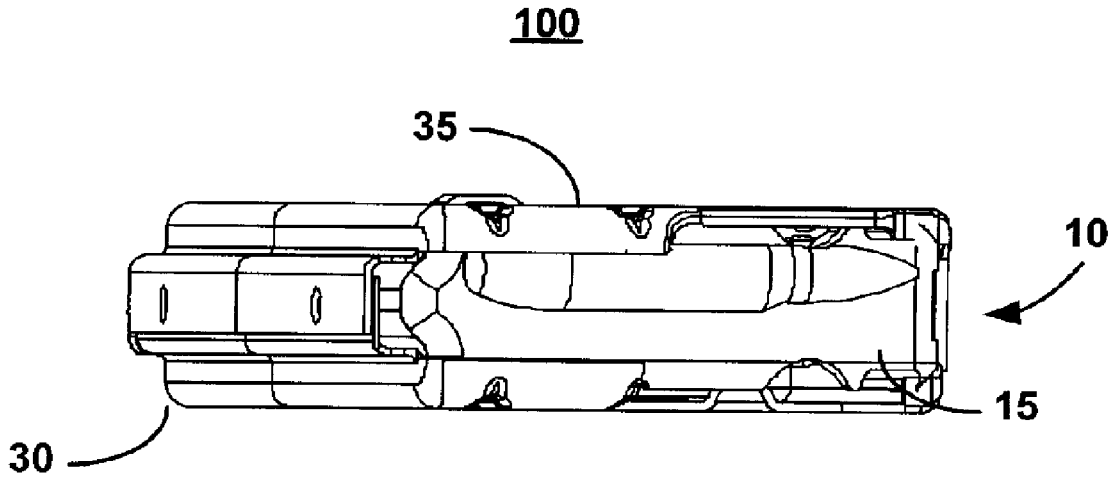
Figure 1F:
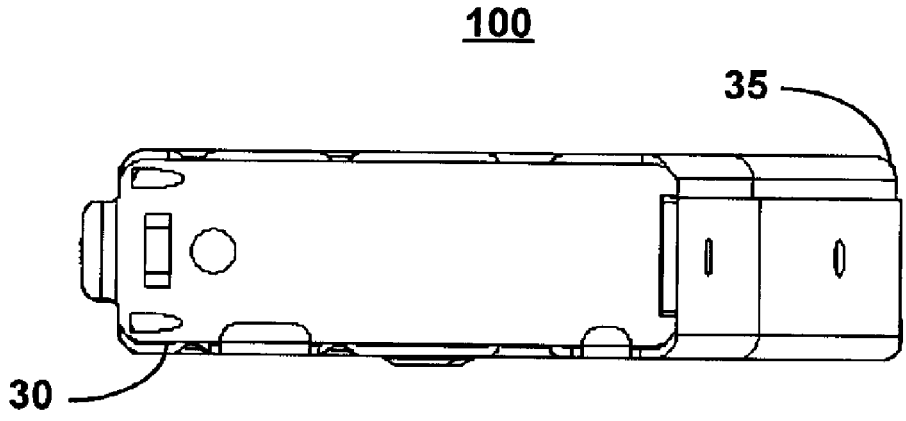

It should be understood that the sizes of the different components in the figures may not be in exact proportion and are shown for visual clarity and for the purpose of explanation.

DETAILED DESCRIPTION OF PREFERRED EMBODIMENTS

FIG. 1 (FIGS. 1A, 1B, 1C, 1D, 1E, and 1F) illustrates an exemplary magazine 100 comprising a magazine follower 10. FIGS. 1A and 1B are cut away views of the magazine 100 illustrating a placement of the magazine follower 10 within the magazine 100. FIGS. 1C and 1D illustrate side views of magazine 100. FIG. 1E illustrates a top view of the magazine 100. FIG. 1F illustrates a bottom view of the magazine follower 100.

The magazine follower 10 comprises a follower plate 15, a spring 20, and a base plate 25. The base plate 25 fits into a bottom 30 of magazine 100. The spring 20 is fastened to the base plate 25 and to the follower plate 15. Force is applied to the follower plate 15 by the spring 20, pushing the follower plate 15 to a top 35 of magazine 100. To load magazine 100, one or more rounds of ammunition (not shown) are inserted into the top 35 of magazine 100, pushing the follower plate 15 toward the bottom 30 of magazine 100. The exemplary magazine 100 can accommodate 30 rounds of ammunition. While the magazine follower 10 is described for illustration purpose only in relation to a 30 round magazine, it should be clear that the magazine follower 10 is applicable as well to, for example, any magazine.

Figure 2A:
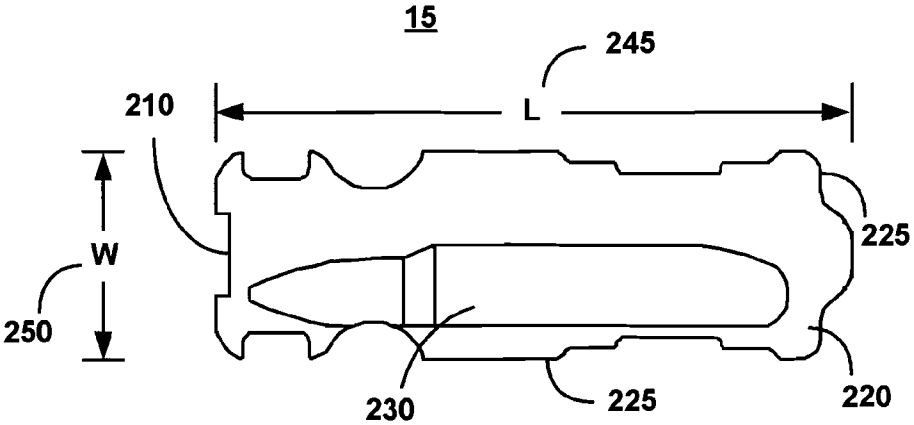
FIG. 2 is comprised of FIGS. 2A and 2B and represents a diagram of a top view and a side view, respectively, of a follower plate of the improved magazine follower of FIG. 1.
Figure 2B:
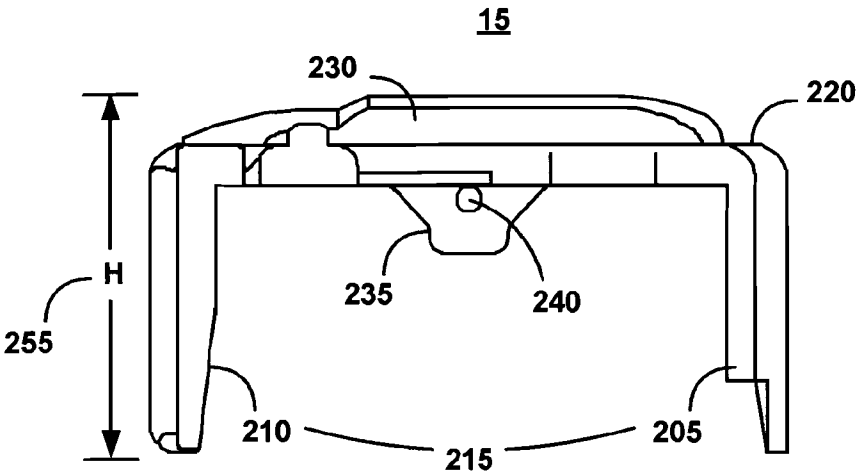

FIG. 2 (FIGS. 2A, 2B) illustrates the follower plate 15. FIG. 2A illustrates a top view of the follower plate 15. FIG. 2B illustrates a side view of the follower plate 15. The follower plate 15 comprises a composite material that exhibits high performance characteristics such as, for example, chemical resistance, heat deflection, tensile strength, stiffness, and low temperature impact strength.

The follower plate 15 comprises a convex follower leg 205 and a concave follower leg 210 (referenced collectively as follower legs 215). The external shape of the follower legs 215 is designed to approximately mirror an interior profile of magazine 100. The external shape and length of the follower legs 215 allows the follower plate 15 to smoothly track the interior of magazine 100, pushing rounds of ammunition up toward the top 35 of magazine 100 without binding or jamming. The follower legs 215 constrain the follower plate 15 to a well-defined path in the interior of magazine 100 while moving up and down in the interior of the magazine 100.

The follower plate 15 further comprises a top plate 220. A top plate perimeter 225 of the top plate 220 as shown in the top view of the follower plate 15 in FIG. 2A is designed to approximately mirror an interior profile of magazine 100. As for the follower legs 215, matching the top plate perimeter 225 of the top plate 220 to the interior of magazine 100 allows the follower plate 15 to smoothly track the interior of magazine 100, reducing the possibility of jamming compared with conventional magazine followers. Further, the top plate perimeter 225 allows easy insertion of the magazine follower 10 into magazine 100 for ease of retrofitting magazine 100 with the magazine follower 10.

The follower plate 15 comprises an ammunition-shaped protrusion 230. The ammunition-shaped protrusion 230 acts as a visual aid to personnel as they load magazine 100 with ammunition. The ammunition-shaped protrusion 230 reduces confusion, prompting personnel to load ammunition into magazine 100 in proper orientation. It is off center to force the rounds to stack correctly when loaded.

The follower plate 15 further comprises a central stud 235. The central stud 235 comprises a follower opening 240 through which the spring 20 is fastened. The central stud 235 is situated on the bottom of the follower plate 15 such that the spring 20 applies uniform load across the follower plate 15 as the follower plate 15 is pushed against rounds of ammunition in magazine 100.

For an exemplary magazine 100 with a capacity of 30 rounds, the length L 245 of the follower plate 15 is approximately 6 cm, the width W 250 of the follower plate 15 is approximately 2 cm, and the height H 255 of the follower legs 215 is approximately 3 cm. The follower plate 15 is sized to fit the inside dimensions of magazine 100 in which the follower plate 15 is installed. Surfaces of the follower plate 15 that come in contact with magazine 100 are filleted or chamfered to enhance the ability of the follower plate 15 to smoothly move within magazine 100, reducing the possibility of binding or jamming within magazine 100.

Figure 3A:
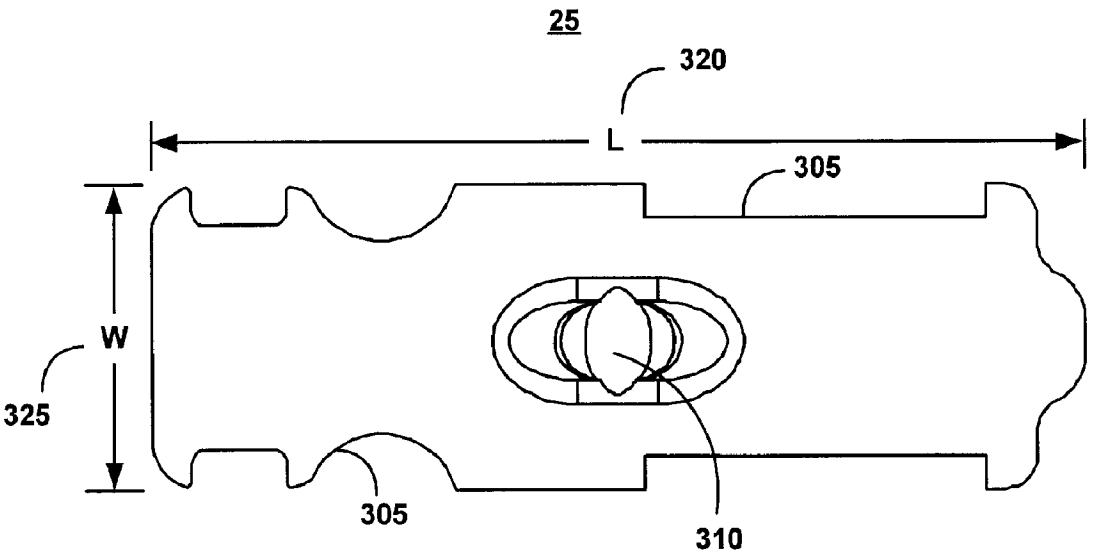
FIG. 3 is comprised of FIGS. 3A and 3B and represents a diagram of a top view, a side view, and an isometric view of a base plate of the improved magazine follower of FIG. 1.
Figure 3B:
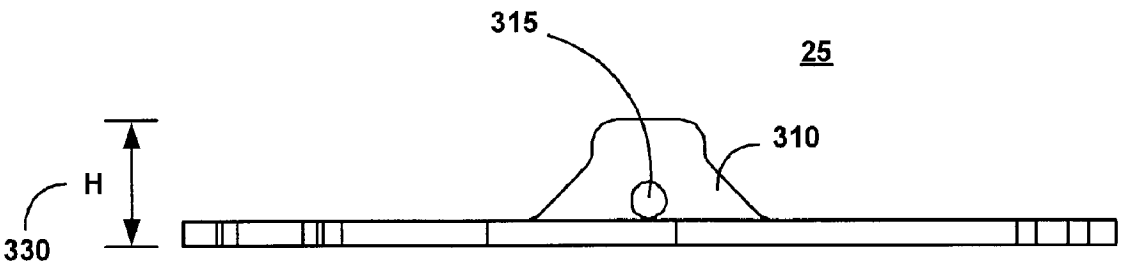

FIG. 3 (FIGS. 3A, 3B) illustrates the base plate 25. FIG. 3A illustrates a top view of the base plate 25. FIG. 3B illustrates a side view of a base plate 25. FIG. 3 illustrates an isometric top view of the base plate 25. The base plate 25 comprises of a glass-reinforced nylon.

The base plate 25 comprises a base plate perimeter 305 as seen in the top view of the base plate 25 in FIG. 3A. The base plate perimeter 305 approximately mirrors the interior profile of magazine 100. The base plate perimeter 305 of the base plate 25 allows easy insertion of the magazine follower 10 into magazine 100 for ease of retrofitting magazine 100 with the magazine follower 10.

The base plate 25 further comprises a base plate stud 310. The base plate stud 310 comprises a base opening 315 through which an end of the spring 20 is fastened. The base plate stud 310 is situated on top of the base plate 25 such that the spring 20 applies uniform load across the follower plate 15 as the follower plate 15 is pushed against rounds of ammunition in magazine 100.

For an exemplary magazine 100 with a capacity of 30 rounds, the length L 320 of the base plate 25 is approximately 6 cm, the width W 325 of the base plate 25 is approximately 2.5 cm, and the height H 330 of the base plate 25 is approximately 0.1 cm. The base plate 25 is sized to fit the inside dimensions of magazine 100 in which the base plate 25 is installed.

Figure 4A:
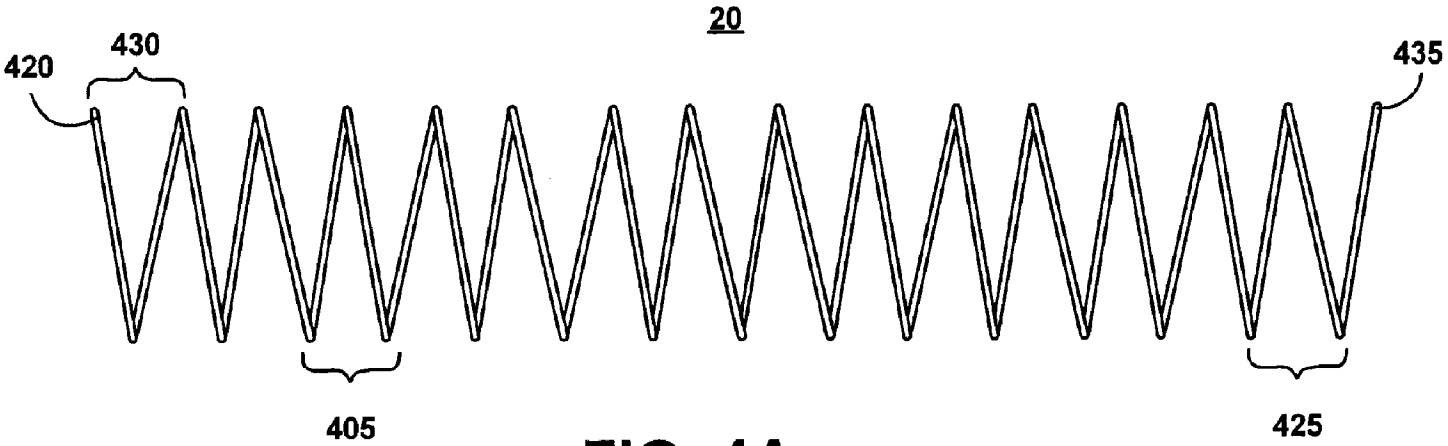
FIG. 4 is comprised of FIGS. 4A and 4B and represents a diagram of a side view and an end view of a spring of the improved magazine follower of FIG. 1 used to apply force to the follower plate of FIG. 2.
Figure 4B:
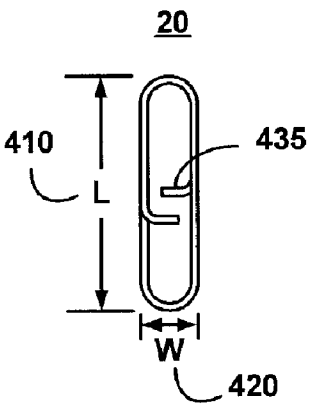

FIG. 4 (FIGS. 4A, 4B) illustrates spring 20. Spring 20 is comprised of a stainless steel wire. Spring 20 comprises approximately 15 turns of wire such as, for example, turn 405. While 15 turns are illustrated in the exemplary magazine follower 10 of FIG. 1 and the exemplary spring 20 of FIG. 4, any number of turns of wire may be used in the magazine follower 10 that provide the force needed to propel rounds of ammunition up magazine 100 for chambering in a firearm. A typical spring 20 will comprise a range of 15 to 16 turns.

As further illustrated by FIG. 4A and FIG. 1, spring 20 is substantially elongated in shape, such that a length L 410 in the drawing both L and W are labeled 420 is larger than a width 415 of the spring 20. Further, the length L 410 of the spring 20 is approximately 80% of the length L 320 of the base plate 25 and the width W 415 of the spring 20 is approximately 80% of the width W 325 of the base plate 25. The elongated shape of the spring 20 is selected to provide evenly distributed force across the follower plate 15 as the spring 20 propels the follower plate 15 up magazine 100. The elongated shape of the spring 20 as defined by a ratio of the length L 410 of the spring 20 to the width W 415 of the spring 20 is shown for exemplary purposes only; any shape may be used that fits within magazine 100 and provides adequate force to propel the magazine follower against the rounds of ammunition loaded in magazine 100.

Spring 20 comprises a follower end 420 and a base end 435. The follower end 435 fits through the follower opening 240, fastening the spring 20 to the follower plate 15. A first turn 430 of the spring 20 is shaped such that the first turn 430 substantially lies against the follower plate 15, positioning the first turn 430 around the central stud 235. This positioning of the first turn 430 against the follower plate 15 provides an evenly distributed, stable transfer of force from the spring 20 to the rounds of ammunition through the follower plate 15.

The base end 435 of the spring 20 fits through the base opening 315, fastening the spring 20 to the base plate 25. A bottom turn 425 of the spring 20 is shaped such that the bottom turn 425 lies substantially against the base plate 25. This positioning of the bottom turn 425 against the base plate 25 provides a stable positioning of spring 20 within magazine 100.

It is to be understood that the specific embodiments of the invention that have been described are merely illustrative of certain applications of the principle of the present invention. Numerous modifications may be made to the improved magazine follower for a magazine used by a firearm described herein without departing from the spirit and scope of the present invention.

What is claimed is:

1. A follower for use in a magazine of a firearm, comprising:

a follower plate comprising a general concave follower leg, a generally convex follower leg; and a top plate, wherein the top plate includes a perimeter;

an elastic element for continuously applying a force to the follower plate;

a base plate for fastening the elastic element at a bottom of a magazine, constraining the elastic element and providing a stable base from which the elastic element applies a force to the follower plate;

wherein the elastic element comprises:

a follower end that is inserted through a follower opening in the follower plate, fastening the elastic element to the follower plate; and a base end that is inserted through a base opening in the base plate, fastening the elastic element to the base plate;

wherein the width of the elastic element is approximately 80% the width of the base plate so that the elastic element applies a generally uniform load across a substantial area of the follower plate and the base plate, in order to provide a steady support for the elastic element; and wherein the elastic element applies a generally uniform load across a substantial area of the follower plate;

wherein the follower plate including the top plate perimeter, the generally concave follower leg, and the generally convex follower leg, form an outline that mirrors the interior profile of the magazine, such that the follower plate smoothly translates in the magazine, along a well defined path within the magazine, without being obstructed by the interior profile of the magazine.

2. The follower of claim 1, wherein the elastic element comprises a spring.

3. The follower of claim 2, wherein the spring comprises a follower end, a base end, and a plurality of turns.

4. The follower of claim 3, wherein at least one of the turns of the spring near the follower end of the spring presses against the follower plate, allowing the spring to apply a uniform force across the follower plate.

5. The follower of claim 4, wherein at least a portion of one of the turns of the spring near the base end of the spring presses against the base plate.

6. The follower of claim 5, wherein the follower plate comprises a central stud with a follower opening in which the follower end of the spring is inserted.

7. The follower of claim 6, wherein the base plate comprises a base plate stud with a base opening in which the base end of the spring is inserted.

8. The follower of claim 2, wherein the spring comprises approximately 15 turns.

9. The follower of claim 2, wherein the spring comprises a range of approximately 15 to 16 turns.

10. the follower of claim 2, wherein the spring is defined by an axial length and a width, and wherein the axial length is greater than the width.

11. The follower of claim 10, wherein the axial length of the spring is approximately 80% the length of the base plate, and wherein the width of the spring is approximately 80% the width of the base plate.

12. The follower of claim 1, wherein the spring is made of stainless steel.

13. The follower of claim 1, wherein the follower plate is made, at least in part, of a composite material.

14. The follower of claim 1, wherein the follower plate comprises an ammunition-shaped protuberance for providing a visual aid for the correct orientation of the ammunition in the magazine.

15. The follower of claim 1, wherein the base plate is made, at least in part, of glass reinforced nylon.

* * * * *